US006049941A

United States Patent [19]

Vollenweider, II

[11] Patent Number: 6,049,941

[45] Date of Patent: Apr. 18, 2000

[54] PORTABLE BACKPACK VACUUM SYSTEM

[75] Inventor: Edward E. Vollenweider, II, Rochester Hills, Mich.

[73] Assignee: Technical Innovations, Inc., Troy, Mich.

[21] Appl. No.: 09/099,182

[22] Filed: Jun. 18, 1998

[51] Int. Cl.[7] ..... A47L 5/16

[52] U.S. Cl. ..... 15/327.5; 15/409; 451/456

[58] Field of Search ..... 15/327.2, 127.5, 15/330, 409; 451/87, 453, 456

[56] References Cited

U.S. PATENT DOCUMENTS

| | | | |
|---|---|---|---|
| 2,475,832 | 7/1949 | Gilliland | 15/409 |
| 4,223,419 | 9/1980 | Sato et al. | 15/327.5 |
| 4,290,165 | 9/1981 | Hiramatsu et al. | 15/409 |
| 5,040,263 | 8/1991 | Guhne et al. | 15/327.5 |
| 5,228,244 | 7/1993 | Chu | 451/456 |
| 5,255,412 | 10/1993 | Mally et al. | 15/456 |
| 5,297,363 | 3/1994 | Schroder et al. | 451/456 |
| 5,531,639 | 7/1996 | Catalfamo | 451/456 |
| 5,864,919 | 2/1999 | Pineda | 15/409 |
| 5,993,305 | 11/1999 | Chu | 451/456 |

OTHER PUBLICATIONS

"Portavac", Bodi Company Inc., 1 page, (No Date).
"AP22 Air Pump", Blovac, 2 pages, (No Date).

*Primary Examiner*—Terrence R. Till
*Attorney, Agent, or Firm*—Harness, Dickey & Pierce, P.L.C.

[57] ABSTRACT

A portable vacuum system adapted to be worn on the back of an operator for collecting dust and debris generated during use of an air powered tool such as a grinder or a sander. The portable vacuum system is powered by the same pressurized air source used to power the tool, thus eliminating the need to tether the operator to additional hoses. The portable vacuum system comprises a collection bag assembly that has mounted thereto a venturi device which generates a vacuum pressure from a pressurized air supply. A vacuum hose is connected between the vacuum inlet to the venturi device and the power tool. A fluid manifold directs pressurized air through first and second on/off valves to the venturi device and the power tool to provide the operator with the ability to separately control the supply of pressurized air to each device.

9 Claims, 2 Drawing Sheets

PORTABLE BACKPACK VACUUM SYSTEM

TECHNICAL FIELD

The present invention relates generally to a vacuum system, and more particularly to a portable backpack vacuum system.

DISCUSSION

In the workplace where operators utilize cutting or abrading tools high volumes of particulate matter are commonly present in the ambient environment and on surfaces surrounding the operator. The particulate matter is a by-product of cutting or abrading work surfaces. The particulate matter can range in size and composition from small dust-like particles associated with abrading fiberglass or similar compositions to large shavings associated with cutting wood or wood-related products.

It is commonly known that particulate matter in the workplace has a variety of detrimental effects. These include: obscuring of the work surface of a work piece making it more difficult to work the piece, air quality contamination due to particulate matter in the ambient environment, contamination of clothing and exposed skin surfaces and interference with the operation of the abrading or cutting tool. In order to address these issues, several approaches have been employed to capture the particulate matter. These include the use of traditional shop vac devices which do little to address particulate matter in the ambient environment, to the use of stationary vacuum systems which employ plenums with multiple vacuum lines emanating therefrom that are adapted to be coupled to an abrading or cutting tool.

Although effective, stationary systems are typically large and expensive, and inhibit the mobility and flexibility of the operator due to the need for the operator to be tethered to at least two lines, one from a vacuum source and one from a pressure source typically required to operate the tool. Stationary systems also interfere with the ability of the operator to work over distances and/or with ease of movement due to the cumbersome nature of the system. Finally, such systems are difficult to use with smaller tools, such as sanders or grinders.

It is therefore desirable to provide a portable backpack vacuum system to capture particulate matter in which the operator can have the necessary mobility, flexibility and ease of use.

SUMMARY OF THE INVENTION

Accordingly, it is an object of the present invention to provide a portable backpack vacuum system having a fluid conduit system in communication with a pressurized fluid, the fluid conduit system having a first and second flow path, the first flow path being in communication with a tool to power the tool and the second flow path being coupled to a venturi device for creating a negative pressure or vacuum in a vacuum line for drawing particulate matter through an inlet end of the vacuum line positioned adjacent to the tool into a collection bag worn on the back of the operator.

It is a further object of the present invention to provide a portable backpack vacuum system that is worn by the operator.

It is a further object of the present invention to provide a portable backpack vacuum system that is collapsible.

It is a further object of the present invention to provide a portable backpack vacuum system that is lightweight, flexible, and easy to use.

It is a further object of the present invention to provide a portable backpack vacuum system that is operable by a single pressure source.

It is a further object of the present invention to provide a portable backpack vacuum system that has a backpack partially constructed of an air resistant cloth.

It is a further object of the present invention to provide a portable backpack vacuum system that operates to capture particulate matter.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict a preferred embodiment of the present invention and are not therefore to be considered limiting in scope, the invention will be described and explained with additional specificity and detail through the use of the accompanying drawings in which.

DETAILED DESCRIPTION OF THE PREFERRED EMBODIMENTS

Figure 1:
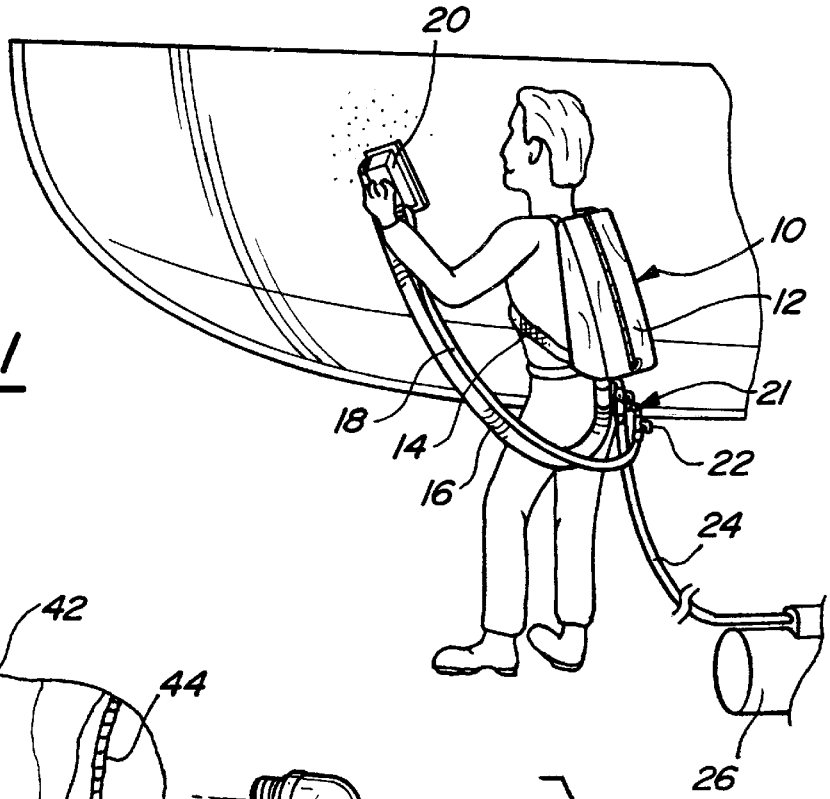
FIG. 1 is a perspective view of the present invention in a work environment.
Figure 2:
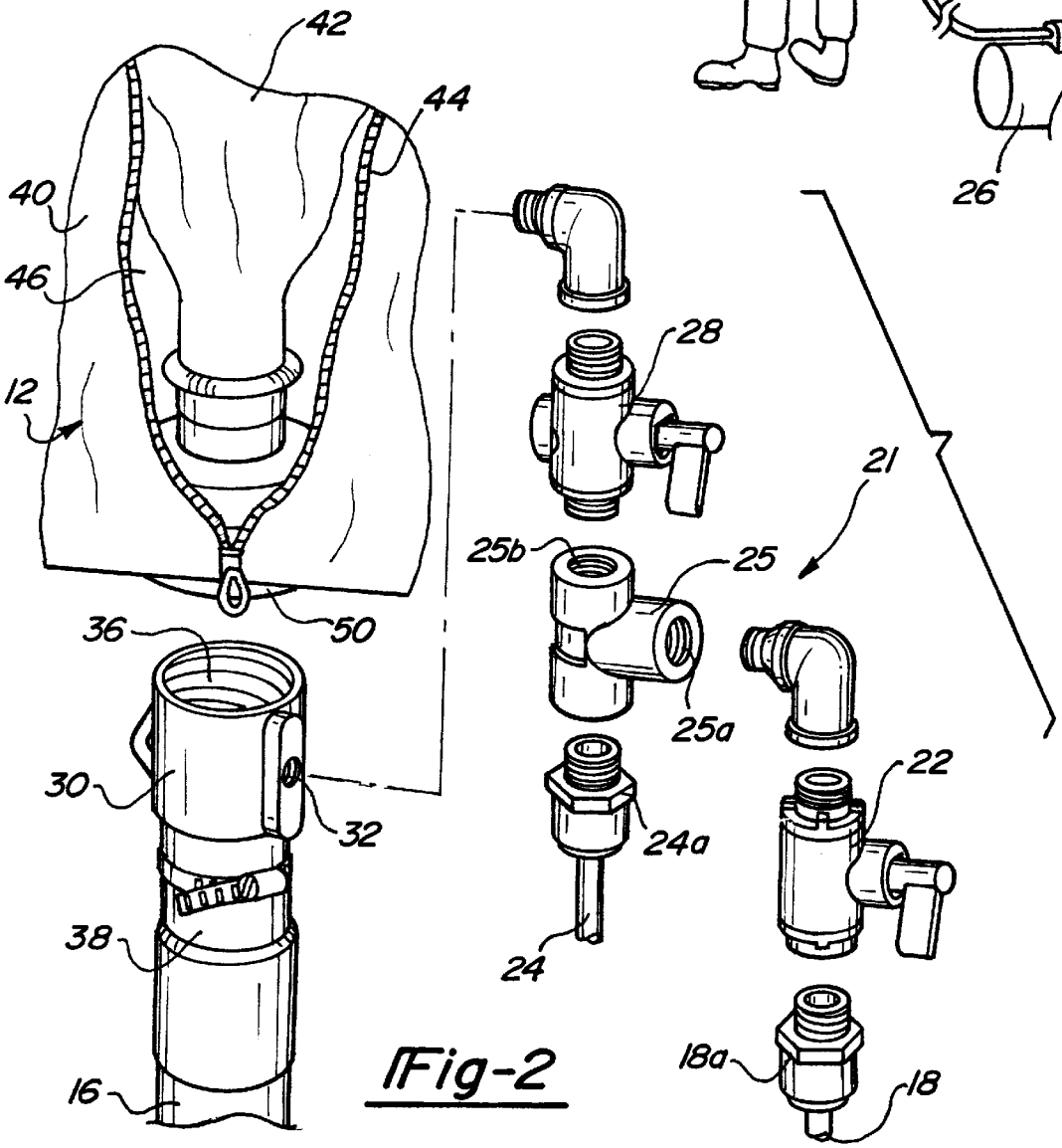
FIG. 2 is an exploded view of a conduit system illustrated in FIG. 1.

Referring to FIG. 1, the portable vacuum system 10 according to the present invention is shown. In general, the vacuum system 10 comprises a collection bag assembly 12 that is adapted to be worn on the back of the user and which is held in place by a pair of shoulder straps 14 in the manner of a backpack. Emanating from a vacuum source (to be subsequently described) connected to the base of the collection bag assembly 12 is a vacuum hose 16 that is adapted to be connected to the power tool 20 being used by the operator to draw the dirt and debris created during operation of the power tool into the collection bag assembly 12. The power tool 20 is powered by compressed air which is delivered to the tool via a compressed air line 18 that is connected at one end to the tool and at its other end to a fluid conduit system 21 that is coupled to and carried by the collection bag assembly 12. The fluid conduit system 21 is adapted to be connected via an air line 24 to a remotely located source of compressed air 26. In particular, as best shown in FIG. 2, the compressed air supply from supply line 24 is delivered via a T-junction 25 to a first on/off valve 22 connected to a first output port 25*a* of T-junction 25 and to a second on/off valve 28 connected to a second output port 25*b*. The other side of the on/off valve 22 is connected to air line 18 which supplies compressed air to the tool 20.

The other side of the second on/off valve 28 is connected to the compressed air inlet 32 of a venturi-type air pump device 30 that couples the fluid conduit system 21 to the collection bag assembly 12. The venturi device 30 generates a vacuum pressure from a source of compressed air which is supplied to its air supply inlet 32. Thus, the operator can selectively control the operation of the power tool 20 and the vacuum system 10 by controlling the positions of on/off valves 22 and 28, respectively.

Figure 3:
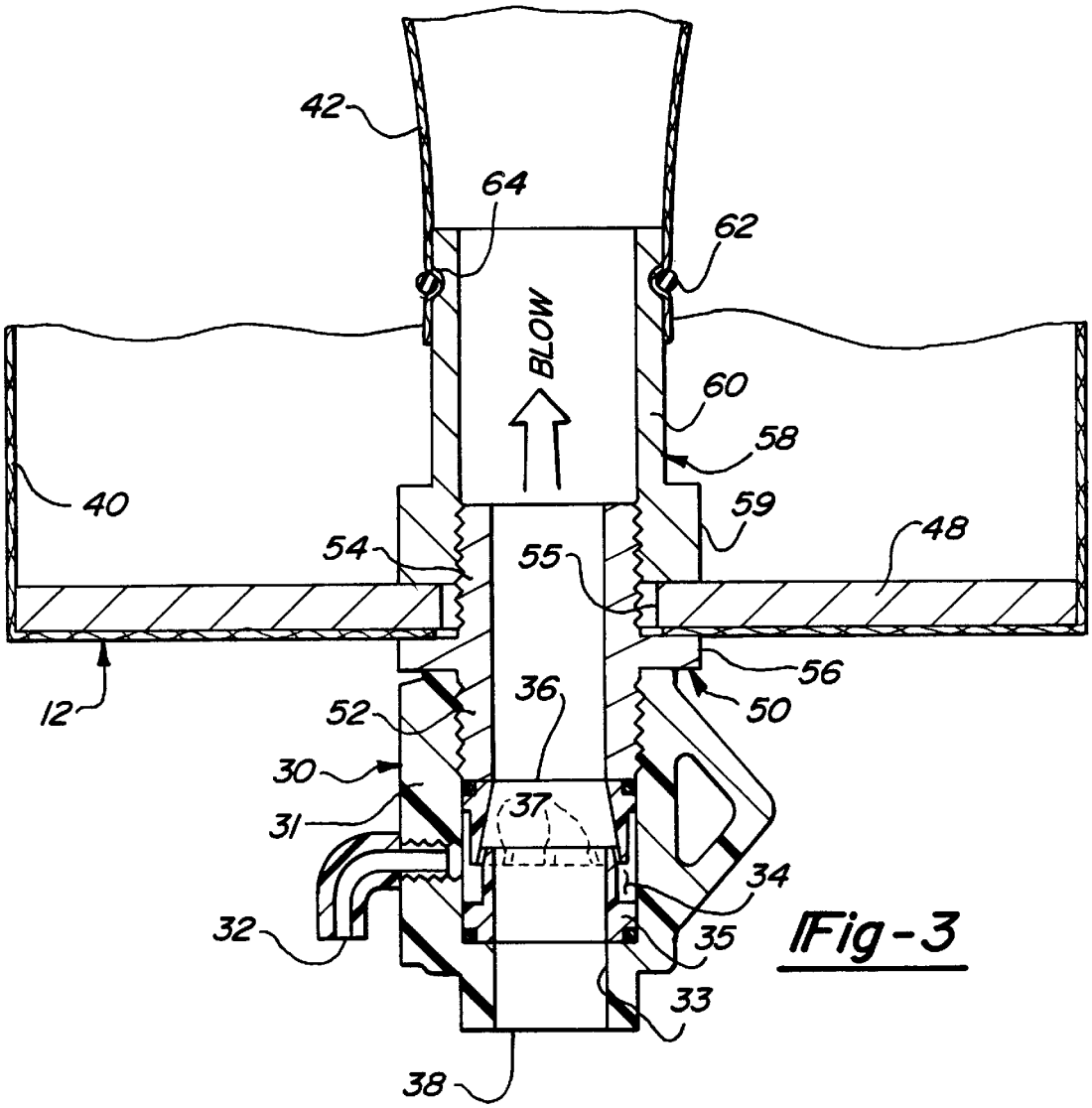
FIG. 3 is an enlarged sectional view of the lower portion of the bag assembly showing the venturi device connected to the base of the bag assembly.

Referring to FIG. 3, the venturi device 30 comprises a generally cylindrical body 31 having a central bore 33 formed along its length. Housed within the enlarged central portion of the body 31 is a directional air spool 35 which is sealed within the body and defines an annular-shaped air chamber 34 that communicates with the air inlet 32. A plurality of air directing holes 37 are formed through one of the end flanges of the spool 35 to provide a fluid path between the annular air chamber 34 and the central bore 33. Thus, when compressed air is supplied to air inlet 32, the compressed air is directed into the annular air chamber 34 and out through the plurality of holes 37 into the central bore 33. The resulting rapid expansion of the pressurized air as it is expelled through the holes 37 and out outlet port 36 creates a vortex action which in turn generates a vacuum pressure at inlet port 38. Thus, by supplying compressed air to inlet 32, a source of vacuum is generated at vacuum inlet 38. A venturi device suitable for use with the present invention is available from Blowvac, in Queensland, Australia.

Returning to FIG. 2, the vacuum hose 16 from the power tool 20 is connected to the vacuum inlet 38 of the venturi device 30 and the air outlet 36 of the device 30 is threadedly connected to a through fitting 50 mounted to the base 48 of the collection bag assembly 12. The collection bag assembly 12 comprises an outer air permeable fabric bag 40 that can be opened via a zipper closure 44 to reveal an air permeable inner filter bag 42. Filter bag 42 is preferably made of a cellulose material that is capable of trapping particles greater than one (1) micron in size. Of course, other types of filter bags 42 may be readily used depending upon the application and the expected size of the particles to be trapped or filtered by the vacuum apparatus. The back panel 46 of the outer bag 40, which is intended to rest against the back of the wearer when in use, is preferably made from a non-air permeable material, such as a plastic coated fabric material, to prevent air exhausted from the bag assembly 12 from blowing directly onto the back of the wearer. The base 48 of the bag assembly 12 is preferably made from a rigid plastic material to provide shape to the bag assembly 12 and also to provide a rigid mounting for the fitting 50 which extends through the base 48 of the bag 40.

As best shown in FIG. 3, fitting 50 comprises a first threaded portion 52 which extends downwardly from the base 48 of the bag 40 and is threadedly connected to the venturi air outlet 38 as described above, and a second threaded portion 54 that extends through a hole 55 formed in the base 48 of the collection bag assembly 12. A tubular nozzle 58 with an enlarged threaded end 59 is threadably secured to the second threaded portion 54 of fitting 50 so that the base 48 of the collection bag assembly 12 is tightly secured between the enlarged end 59 of nozzle 58 and a flange 56 formed on the fitting 50 intermediate the two threaded portions 52 and 54. The tubular portion 60 of the nozzle 58 extends upwardly into the interior of the bag 40 and provides a means for connecting to the filter bag 42. In particular, the necked-down opening of the filter bag 42 is adapted to be drawn over the tubular portion 60 and tightly secured thereto by a resilient collar member 62 which is adapted to grip the bag in an arcuate groove 64 formed around the periphery of the tubular portion 60 as shown. Thus, debris laden air drawn through the vacuum hose 16 is blown through the fitting 50 and nozzle 58 secured to the base 48 of the bag 40 into the filter bag 42.

Significantly, it will be appreciated that the portable vacuum system 10 according to the present invention does not require the operator to be tethered to additional hoses or power cords that could hamper the mobility of the operator. In particular, in many industrial applications, such as the manufacture of fiberglass boats, it is frequently necessary for the operator to move about a large work area. Consequently, being tethered to multiple hoses and/or cords can significantly hamper the work efficiency of an operator. Thus, a vacuum system that requires the operator to be tethered to a separate vacuum hose is a significant disadvantage.

The present portable vacuum system 10, however, requires no such additional hoses. Specifically, the only hose limiting the mobility of the operator is the single air supply hose 24 required to operate the power tool 20. In other words, the same source of compressed air that is used to operate the power tool 20 is also used by the present invention to generate the vacuum source for the portable vacuum system 10. Consequently, the operator is not tethered to a separate vacuum hose line. Moreover, this configuration provides the additional benefit of limiting the required length of vacuum hose 16 which, being a relatively large diameter hose, is bulky and therefore can be difficult to manage in long lengths. Thus, as the vacuum source in the present system is portable and coupled to the vacuum bag assembly 12, the required length of vacuum hose is very short.

Finally, while the embodiment of the present invention illustrated in FIG. 2 shows threaded connectors 18*a* and 24*a* for connecting the air lines 18 and 24 from the remotely located source of compressed air 26 and the power tool 20, respectively, it will readily be appreciated that quick-disconnect type air fittings could alternatively be employed.

The foregoing discussion discloses and describes merely exemplary embodiments of the present invention. One skilled in the art will readily recognize from such discussion, and from the accompanying drawings and claims, that various changes, modifications, and variations can be made therein without departing from the spirit and scope of the invention as defined in the following claims.

What is claimed is:

1. A portable vacuum system for use by an operator of an air powered tool that creates dust and debris during operation, comprising:

a collection container comprising a fabric bag that is adapted to be worn on the back of the operator and having a non-air permeable back panel adapted to rest on the back of the operator, and an intake for receiving dust and debris for collection in the container;

a vacuum generating device having a pressurized air inlet for receiving a source of pressurized air, a vacuum inlet at which a vacuum pressure is generated, and an air outlet at which the pressurized air is exhausted, said air outlet being connected to the intake of said collection container;

a vacuum hose connected between the tool and the vacuum inlet of said vacuum generating device; and a fluid conduit system having an input adapted for connection to an air supply conduit coupled to a remotely located source of pressurized air, a first output connected to the pressurized air inlet of said vacuum generating device, and a second output adapted for connection to an air supply conduit coupled to the tool.

2. The portable vacuum system of claim 1 wherein said fluid conduit system includes a first on/off valve for controlling the flow of pressurized air to the tool and a second on/off valve for controlling the flow of pressurized air to the vacuum generating device.

3. The portable vacuum system of claim 1 wherein said collection container includes an inner filter bag, and a through fitting located in the base of the container having a first end that is adapted for connection to the filter bag and a second end adapted for connection to the air outlet of said vacuum generating device.

4. The portable vacuum system of claim 1 wherein said vacuum generating device comprises a venturi-type air pump device.

5. A portable vacuum system for use by an operator of an air powered tool that creates dust and debris during operation, comprising:

a collection container adapted to be carried by the operator and having an intake for receiving dust and debris for collection in the container;

a vacuum generating device having a pressurized air inlet for receiving a source of pressurized air, a vacuum inlet at which a vacuum pressure is generated, and an air outlet at which the pressurized air is exhausted, said air outlet being connected to the intake of said collection container;

a vacuum hose connected between the tool and the vacuum inlet of said vacuum generating device; and a fluid conduit system having an input adapted for connection to an air supply conduit coupled to a remotely located source of pressurized air, a first output connected to the pressurized air inlet of said vacuum generating device, a second output adapted for connection to an air supply conduit coupled to the tool, a first on/off valve for controlling the flow of pressurized air to the tool, and a second on/off valve for controlling the flow of pressurized air to the vacuum generating device.

6. The portable vacuum system of claim 5 wherein said collection container including an inner filter bag, and a through fitting located in the base of the container having a first end that is adapted for connection to the filter bag and a second end adapted for connection to the air outlet of said vacuum generating device.

7. The portable vacuum system of claim 5 wherein said vacuum generating device comprises a venturi-type air pump device.

8. A portable vacuum system for use by an operator of an air powered tool that creates dust and debris during operation, comprising:

a collection contained adapted to be carried by the operator and having an intake for receiving dust and debris for collection in the container, said collection container including an inner filter bag, and a through fitting located in the base of the container having a first end that is adapted for connection to the filter bag and a second end adapted for connection to the air outlet of said vacuum generating device, a vacuum generating device having a pressurized air inlet for receiving a source of pressurized air, a vacuum inlet at which a vacuum pressure is generated, and an air outlet at which the pressurized air is exhausted, said air outlet being connected to the intake of said collection container;

a vacuum hose connected between the tool and the vacuum inlet of said vacuum generating device; and a fluid conduit system having an input adapted for connection to an air supply conduit coupled to a remotely located source of pressurized air, a first output connected to the pressurized air inlet of said vacuum generating device, and a second output adapted for connection to an air supply conduit coupled to the tool.

9. The portable vacuum system of claim 8 wherein said vacuum generating device comprises a venturi-type air pump device.

* * * * *